US010732527B2

(12) United States Patent
Takeuchi et al.

(10) Patent No.: US 10,732,527 B2
(45) Date of Patent: Aug. 4, 2020

(54) ELECTROPHOTOGRAPHIC PHOTORECEPTOR, METHOD FOR MANUFACTURING SAME, AND ELECTROPHOTOGRAPHIC APPARATUS USING SAME

(71) Applicant: FUJI ELECTRIC CO., LTD., Kawasaki-shi, Kanagawa (JP)

(72) Inventors: Masaru Takeuchi, Matsumoto (JP); Hirotaka Kobayashi, Matsumoto (JP); Toshiki Obinata, Azumino (JP); Fengqiang Zhu, Matsumoto (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 0 days.

(21) Appl. No.: 16/264,184

(22) Filed: Jan. 31, 2019

(65) Prior Publication Data

US 2019/0163077 A1 May 30, 2019

Related U.S. Application Data

(63) Continuation of application No. PCT/JP2017/043870, filed on Dec. 6, 2017.

(30) Foreign Application Priority Data

Feb. 20, 2017 (JP) ..... 2017-029102

(51) Int. Cl.
*G03G 5/05* (2006.01)
*G03G 5/06* (2006.01)
*G03G 15/00* (2006.01)

(52) U.S. Cl.
CPC ..... *G03G 5/0564* (2013.01); *G03G 5/0614* (2013.01); *G03G 5/0631* (2013.01);
(Continued)

(58) Field of Classification Search
CPC .. G03G 5/0564; G03G 5/0696; G03G 5/0631; G03G 5/0614; G03G 15/75; G03G 2215/00957; G03G 5/0672
See application file for complete search history.

(56) References Cited

U.S. PATENT DOCUMENTS

2012/0100474 A1* 4/2012 Hikosaka ..... C08G 64/10 430/69
2013/0022902 A1 1/2013 Shimoyama et al.
(Continued)

FOREIGN PATENT DOCUMENTS

JP H03-172852 A 7/1991
JP 2005-208597 A 8/2005
(Continued)

*Primary Examiner* — Thorl Chea
(74) *Attorney, Agent, or Firm* — Rabin & Berdo, P.C.

(57) ABSTRACT

An electrophotographic photoreceptor of a negatively-chargeable laminate-type includes a conductive substrate; a charge generation layer provided on the conductive substrate and including a charge generating material; and a charge transport layer provided on the charge generation layer and containing, as a binder resin, a copolymerized polycarbonate resin having a repeating unit represented by Formula (1); as a hole transporting substance, a compound having a structure represented by Formula (2); as an electron transporting substance, a compound having a structure represented by Formula (3), and, as an antioxidant, a compound represented by Structural Formula (4), where a mass ratio H/(B+H) represents a ratio of mass (H) of the hole transporting substance with respect to a sum of mass (B) of the binder resin and the mass (H) of the hole transporting substance, and satisfies Formula (5), 0.20 by mass≤H/(B+H)≤0.35 by mass, (Continued)

(1)

(2)

(3)

and

-continued (4)

5 Claims, 1 Drawing Sheet

(52) U.S. Cl.
CPC ..... *G03G 5/0672* (2013.01); *G03G 5/0696* (2013.01); *G03G 15/75* (2013.01); *G03G 2215/00957* (2013.01)

(56) References Cited

U.S. PATENT DOCUMENTS

| | | | |
|---|---|---|---|
| 2013/0316278 | A1 | 11/2013 | Zhu et al. |
| 2013/0330104 | A1 | 12/2013 | Shimoyama et al. |
| 2014/0206814 | A1 | 7/2014 | Morishita et al. |
| 2016/0018746 | A1 | 1/2016 | Nagao et al. |
| 2016/0116854 | A1 | 4/2016 | Hirata et al. |
| 2016/0282732 | A1 | 9/2016 | Shimizu et al. |
| 2018/0024449 | A1 | 1/2018 | Zhu et al. |
| 2018/0307147 | A1 | 10/2018 | Suzuki et al. |

FOREIGN PATENT DOCUMENTS

| | | | |
|---|---|---|---|
| JP | 2007-271962 | A | 10/2007 |
| JP | 2008-176054 | A | 7/2008 |
| JP | 2010-79293 | A | 4/2010 |
| JP | 2013-29789 | A | 2/2013 |
| JP | 2013-41259 | A | 2/2013 |
| JP | 2014-13379 | A | 1/2014 |
| JP | 2014-209224 | A | 11/2014 |
| JP | 2015-22101 | A | 2/2015 |
| JP | 2015-25912 | A | 2/2015 |
| JP | 2015-141235 | A | 8/2015 |
| JP | 2016-180845 | A | 10/2016 |
| JP | 2016-180846 | A | 10/2016 |
| JP | 2016-224108 | A | 12/2016 |
| WO | WO-2012/77206 | A1 | 6/2012 |
| WO | WO-2013/027654 | A1 | 2/2013 |
| WO | WO-2014/192633 | A1 | 12/2014 |
| WO | WO-2017/072972 | A1 | 5/2017 |
| WO | WO-2018/016156 | A1 | 1/2018 |
| WO | 2018/150693 | A1 * | 8/2018 |

* cited by examiner

ELECTROPHOTOGRAPHIC PHOTORECEPTOR, METHOD FOR MANUFACTURING SAME, AND ELECTROPHOTOGRAPHIC APPARATUS USING SAME

CROSS-REFERENCE TO RELATED APPLICATIONS

This non-provisional application is a continuation of International Application No. PCT/JP2017/043870 filed on Dec. 6, 2017, which claims priority from Japanese Patent Application No. 2017-029102 filed on Feb. 20, 2017, the entire contents of both of which are incorporated herein by reference.

BACKGROUND OF THE INVENTION

1. Field of the Invention

The present invention relates to a negatively-chargeable laminate-type electrophotographic photoreceptor (hereinafter, also simply referred to as "photoreceptor") used in electrophotographic printers, copying machines, facsimile machines and the like. More particularly, the present invention relates to: an electrophotographic photoreceptor which contains specific binder resin, hole transporting substance, electron transporting substance and antioxidant in a charge transport layer and can thereby realize excellent wear resistance, light resistance, and repeated-use potential stability; a method of producing the same; and an electrophotographic device using the same.

2. Background of the Related Art

As electrophotographic photoreceptors in electrophotographic application devices employing the Carlson method such as copying machines, printers and facsimile machines, conventionally, inorganic photoreceptors utilizing an inorganic photoconductive material such as selenium, selenium alloy, zinc oxide or cadmium sulfide have been used in many cases. In recent years, however, organic photoreceptors utilizing an organic photoconductive material have been actively developed, taking advantage of their pollution-free properties, film-forming properties and lightweightness.

Particularly, so-called function-separated laminate-type organic photoreceptors, in which a photosensitive layer is a laminate that is functionally separated into a charge generation layer primarily having a function of generating a charge carrier upon receiving light and a charge transport layer primarily having functions of maintaining a charge potential in dark and transporting the charge carrier upon receiving light, have been the mainstream in organic photoreceptors since such photoreceptors have many advantages in that, for example, their properties can be easily controlled by forming each layer using a material suitable for the function of the layer.

In recent years, from the standpoints of an increase in the printing volume per electrophotographic device due to centralized printing associated with networking in offices and a reduction in the running cost, organic photoreceptors are demanded to have a longer service life, and a wide variety of photoreceptors have been proposed by manufacturers.

Photoreceptors in which wear resistance is dramatically improved by arranging a surface protective layer on a charge transport layer have recently been proposed; however, in such photoreceptors, there is a problem that an excessively high hardness of the photoreceptor surface rather accelerates wear and deterioration of peripheral members such as charging rollers and cleaning blades. As a countermeasure against such a problem, it is necessary to use high-quality peripheral members that are less likely to wear out, and this consequently makes electrophotographic devices expensive as a whole.

In addition, an increase in the material cost and man-hours due to an addition of a surface protective layer to the layer configuration of a conventional photoreceptor also makes the photoreceptor itself expensive; therefore, a surface protective layer remains applied only to those photoreceptors used in some of high-grade electrophotographic devices such as quick printers.

In order to solve these problems, Patent Document 1 (Japanese Unexamined Patent Application Publication No. 2005-208597) proposes a photoreceptor in which wear resistance and gas resistance are improved by incorporating a copolymerized polycarbonate having a specific structural unit as a binder resin and a hole transport agent having a specific triphenylamine moiety a charge transport agent into a charge transport layer. However, even in this photoreceptor, the wear resistance is not sufficient, and there is a problem that the photoreceptor is fatigued by exposure to light when, for example, the photoreceptor is integrated into a cartridge and the user installs the photoreceptor cartridge in an electrophotographic device, and this causes a reduction in charge retainability in dark as well as a reduction in sensitivity, as a result of which these defects appear as density unevenness on the resulting image.

Furthermore, Patent Document 2 (Japanese Unexamined Patent Application Publication No. 2008-176054) proposes to incorporate filler particles into the outermost layer of a photoreceptor in a predetermined dispersed state for the purpose of improving the wear resistance; however, this technology has a drawback in that the effects of particle aggregation during the preparation of a photosensitive layer coating liquid on the photoreceptor properties and the effects of a surface treatment of the particles have not been sufficiently verified.

The present invention was made in view of the above-described circumstances, and an object of the present invention is to inexpensively provide: a highly sensitive electrophotographic photoreceptor which has excellent wear resistance and exhibits excellent light resistance and repeated-use potential stability even without a surface protective layer being arranged on a charge transport layer; a method of producing the same; and an image-forming device equipped with the same.

SUMMARY OF THE INVENTION

The present inventors intensively studied to solve the above-described problems and consequently discovered that, in a negatively-chargeable laminate-type electrophotographic photoreceptor, the wear resistance of the surface of a charge transport layer is improved and the image density unevenness caused by light-induced fatigue is suppressed by incorporating specific binder resin, hole transporting substance, electron transporting substance and antioxidant into the charge transport layer and controlling the mass ratio of the binder resin and the hole transporting substance in a specific range, thereby completing the present invention.

That is, the electrophotographic photoreceptor of the present invention is a negatively-chargeable laminate-type electrophotographic photoreceptor including: a conductive substrate; a charge generation layer that is provided on the conductive substrate and that includes a charge generating material; and a charge transport layer that is provided on the charge generation layer and that comprises:

as a binder resin, a copolymerized polycarbonate resin having a repeating unit represented by General Formula (1) below:

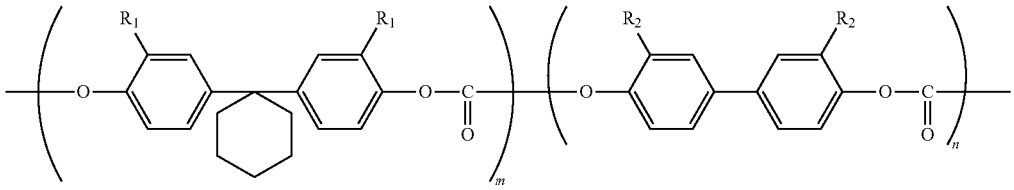

(1)

where, $R_1$ and $R_2$, are the same or different and each represents a hydrogen atom, an alkyl group having 1 to 10 carbon atoms, or a fluoroalkyl group having 1 to 10 carbon atoms; n and m satisfy $0.4 \leq n/(m+n) \leq 0.6$; and a chain terminal group is a monovalent aromatic group or a monovalent fluorine-containing aliphatic group;

as a hole transporting substance, a compound having a structure represented by General Formula (2) below:

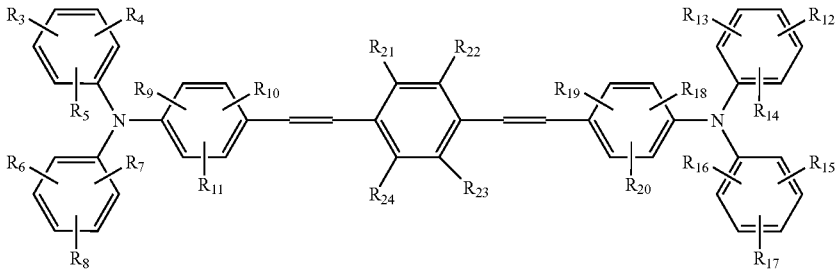

(2)

where, $R_3$ to $R_{24}$ are the same or different and each represents a hydrogen atom, a lower alkyl group, a lower alkoxy group, an aryl group, or an aryl group-substituted alkenyl group;

as an electron transporting substance, a compound having a structure represented by General Formula (3) below:

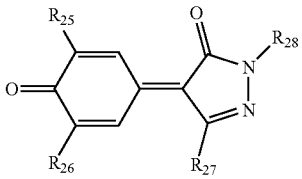

(3)

where, $R_{25}$ to $R_{28}$ are the same or different and each represents a hydrogen atom, a lower alkyl group, a halogen atom, a cyano group, a nitro group, an aryl group optionally having a substituent, or a heterocyclic group optionally having a substituent; and as an antioxidant, a compound represented by Structural Formula (4) below:

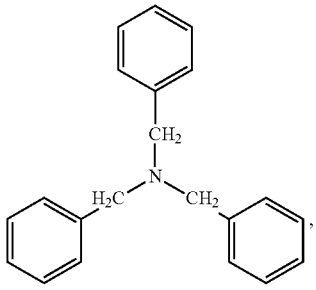

(4)

and a mass ratio H/(B+H), which represents a ratio of mass (H) of the hole transporting substance with respect to a sum of mass (B) of the binder resin and mass (H) of the hole transporting substance in the charge transport layer, satisfies Formula (5) below:

$$20\% \text{ by mass} \leq H/(B+H) \leq 35\% \text{ by mass} \quad (5).$$

Further, the method of producing the above-described electrophotographic photoreceptor according to the present invention includes sequentially forming the charge generation layer and the charge transport layer by repeated dip coating and drying. That is the method of producing the electrophotographic photoreceptor according to the present invention includes providing a first coating solution including materials for the charge generation layer; dip coating the conductive substrate into the first coating solution to provide a first coating on the substrate; drying the first coating to provide the charge generation layer; providing a second coating solution including materials for the charge transport layer; dip coating the charge generation layer into the second coating solution to provide a second coating on the charge generation layer; and drying the second coating to provide the charge transport layer. Drying is accomplished by air drying at ambient temperature and pressure, or drying in a vacuum with or without heating, or drying with heat at ambient pressure.

Still further, the electrophotographic apparatus of the present invention includes: the above-described electrophotographic photoreceptor; a charging device for charging the electrophotographic photoreceptor; an exposure device for exposing the thus-charged electrophotographic photoreceptor to form an electrostatic latent image; a developing device for developing the electrostatic latent image formed on a surface of the electrophotographic photoreceptor with a toner to form a toner image; a transfer device for transferring the toner image formed on the surface of the electrophotographic photoreceptor to a recording medium. The apparatus may include a fixation device for fixing the toner image transferred to the recording medium.

By using a copolymerized polycarbonate resin having a repeating unit represented by the General Formula (1) as a binder resin, excellent wear resistance can be realized and, by using a high-mobility compound having a structure represented by the General Formula (2) as a hole transporting substance, high sensitivity can be maintained even when the mass ratio of the binder resin contributing to the wear resistance is increased; therefore, both high wear resistance and high sensitivity can be realized by controlling the mass ratio between the binder resin and the hole transporting substance to be in the range represented by the Formula (5).

Meanwhile, a compound represented by the General Formula (2) generally has poor resistance against UV light and active gases such as ozone; therefore, high light resistance and high repeated-use potential stability are realized by also using, in combination, an electron transporting substance, which shows absorption in the UV region to function as a UV absorber and has a structure represented by the General Formula (3), and a compound represented by the Structural Formula (4) as an antioxidant.

In addition, as an effect of incorporating an electron transporting substance represented by the Formula (3), there is an advantage that, even when a positive charge is imparted to the photoreceptor surface by triboelectric charging between the photoreceptor and a photoreceptor protective sheet, electrons generated by a charge generation layer can move in a charge transport layer and a positive charge on the photoreceptor surface is cancelled by the electrons and gradually attenuated; therefore, so-called charge memory, which is image unevenness that occurs when the positive charge remains on the surface without being attenuated, does not occur.

According to the present invention, a highly sensitive electrophotographic photoreceptor which has excellent wear resistance and exhibits excellent light resistance and repeated-use potential stability even without a surface protective layer being arranged on a charge transport layer, a method of producing the same, and an image-forming device equipped with the same can be provided inexpensively.

DETAILED DESCRIPTION OF THE INVENTION

Figure 1:
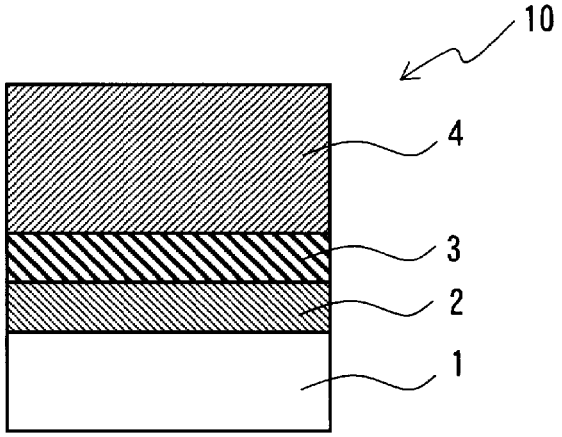
FIG. 1 is a schematic cross-sectional view showing an example of the configuration of the electrophotographic photoreceptor of the present invention.

Embodiments of the present invention will now be described in detail referring to the drawings.

Electrophotographic Photoreceptor

FIG. 1 is a schematic cross-sectional view that illustrates an example of the configuration of the electrophotographic photoreceptor of the present invention, showing a negatively-chargeable laminate-type photoreceptor 10 in which a charge generation layer 3 and a charge transport layer 4 are sequentially arranged in this order on a conductive substrate 1 via an intermediate layer 2. It is noted here that the intermediate layer 2 is arranged as required, and that the charge generation layer 3 and the charge transport layer 4 may be sequentially and directly arranged on the conductive substrate 1.

Conductive Substrate

The conductive substrate 1 not only functions as an electrode of the photoreceptor but also serves as a support of other layers at the same time. The conductive substrate 1 may take any of a cylindrical form, a plate form and a film form; however, it generally takes a cylindrical form. As the material thereof, a known aluminum alloy such as JIS 3003 type, JIS 5000 type or JIS 6000 type, a metal such as stainless steel, nickel or the like, or a glass, a resin or the like on which a conductive treatment is performed, may be used.

The conductive substrate 1 can be finished to have a predetermined dimensional accuracy by an extrusion or drawing process in the case of an aluminum alloy, or injection molding in the case of a resin. As required, the surface of the conductive substrate 1 is processed to have an appropriate roughness by machining with a diamond bit. Thereafter, the thus machined surface is cleaned by degreasing and washing with an aqueous detergent such as a weak alkaline detergent.

On the thus cleaned surface of the conductive substrate 1, the intermediate layer 2 may be arranged as required.

Intermediate Layer

The intermediate layer 2 is composed of a layer containing a resin as a main component or an oxide film of alumite or the like, and it is arranged as required for the purposes of inhibiting injection of unnecessary charge from the conductive substrate 1 to the charge generation layer 3, covering defects on the substrate surface, improving the adhesion of the charge generation layer 3, and the like.

Examples of a binder resin used in the intermediate layer 2 include polycarbonate resins, polyester resins, polyvinyl acetal resins, polyvinyl butyral resins, polyvinyl alcohol resins, vinyl chloride resins, vinyl acetate resins, polyethylenes, polypropylenes, polystyrenes, acrylic resins, polyurethane resins, epoxy resins, melamine resins, silicon resins, polyamide resins, polystyrene resins, polyacetal resins, polyarylate resins, polysulfone resins, methacrylate polymers, and copolymers of these resins, and these binder resins can be used individually, or in combination of two or more thereof as appropriate. Further, a mixture of resins of the same kind but with different molecular weights can be used as well.

In addition, in the binder resin, for example, fine particles of a metal oxide such as silicon oxide, titanium oxide, zinc oxide, calcium oxide, aluminum oxide or zirconium oxide, fine particles of a metal sulfate such as barium sulfate or calcium sulfate, fine particles of a metal nitride such as silicon nitride or aluminum nitride, an organometallic compound, a silane coupling agent, and/or a material formed from an organometallic compound and a silane coupling agent, may also be incorporated. The content of these materials can be arbitrarily set within a range that allows layer formation.

In cases where the intermediate layer 2 contains a resin as a main component, a hole transporting substance or an electron transporting substance can be incorporated therein for the purposes of, for example, imparting charge transportability and reducing charge trap. The content of the hole transporting substance or the electron transporting substance is preferably 0.1 to 60% by mass, more preferably 5 to 40% by mass, with respect to the solid content of the intermediate layer 2. Further, as required, other known additive(s) may also be incorporated into the intermediate layer 2 within a range that does not markedly impair the electrophotographic properties.

The intermediate layer 2 may be a single layer, or two or more layers of different kinds may be laminated and used as the intermediate layer 2. Although the thickness of the intermediate layer 2 is dependent on the composition of the intermediate layer 2, it can be set arbitrarily within a range where there is no adverse effect such as an increase in the residual potential when the photoreceptor is repeatedly and continuously used, and tit is preferably 0.1 to 10 μm.

Charge Generation Layer

The charge generation layer 3 is arranged on the intermediate layer 2. The charge generation layer 3 is formed, for example, by a method of applying a coating liquid in which particles of a charge generating material are dispersed in a binder resin, and generates a charge upon receiving light. It is important that the charge generation layer 3 have a high charge generation efficiency and at the same time an ability to inject a generated charge into the charge transport layer 4, and therefore it is desired to have little electric field dependency and exhibit good injectability even in a low electric field.

The charge generating material is not particularly restricted as long as it is a material that is photosensitive to the wavelength of an exposure light source and an organic pigment such as a phthalocyanine pigment, an azo pigment, a quinacridone pigment, an indigo pigment, a perylene pigment, a polycyclic quinone pigment, an anthanthrone pigment, a benzimidazole pigment or the like can be used. The charge generation layer 3 can be formed by applying a coating liquid prepared by dispersing or dissolving such a charge generating material in a binder resin such as a polyester resin, a polyvinyl acetate resin, a polymethacrylate resin, a polycarbonate resin, a polyvinyl butyral resin, a phenoxy resin or the like, onto the intermediate layer 2.

The content of the charge generating material in the charge generation layer 3 is preferably 20 to 80% by mass, more preferably 30 to 70% by mass, with respect to the solid content in the charge generation layer 3. Further, the content of the binder resin in the charge generation layer 3 is preferably 20 to 80% by mass, more preferably 30 to 70% by mass, with respect to the solid content in the charge generation layer 3. Usually, the thickness of the charge generation layer 3 can be 0.1 μm to 0.6 μm.

Charge Transport Layer

A photoreceptor can be obtained by arranging the charge transport layer 4 on the charge generation layer 3.

The charge transport layer 4 contains, at least: a copolymerized polycarbonate resin having a repeating unit represented by the General Formula (1) as a binder resin; and a compound having a structure represented by the General Formula (2) as a hole transporting substance and, when the mass of the binder resin and that of the hole transporting substance are defined as (B) and (H), respectively, the mass ratio H/(B+H) representing the ratio of the mass (H) of the hole transporting substance with respect to a sum of the mass (B) and the mass (H) satisfies the Formula (5). This mass ratio, H/(B+H), is preferably 20 to 35% by mass, more preferably 25 to 30% by mass.

By controlling the mass ratio to be in the above-described range, high wear resistance can be realized while maintaining an appropriate sensitivity.

In addition, the charge transport layer 4 further contains: a compound having a structure represented by the General Formula (3) as an electron transporting substance; and a compound represented by the Structural Formula (4) as an antioxidant. By this, high light resistance and high repeated-use potential stability are realized in the resulting photoreceptor.

Specific examples of the copolymerized polycarbonate resin having a repeating unit represented by the General Formula (1) that is used as the binder resin constituting the charge transport layer 4 include, but not limited to, the followings.

(B-1)

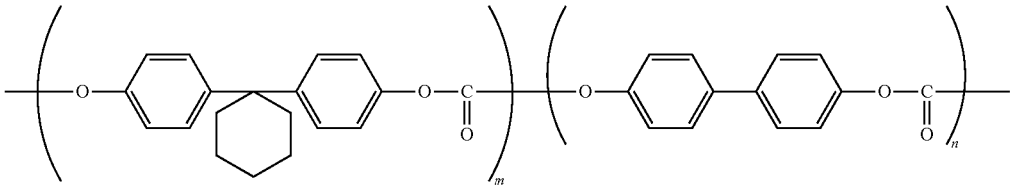

-continued (B-2)

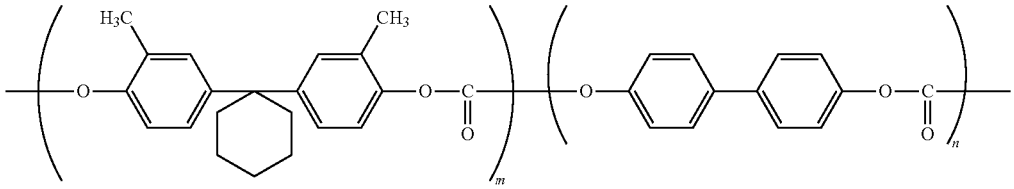

(B-3)

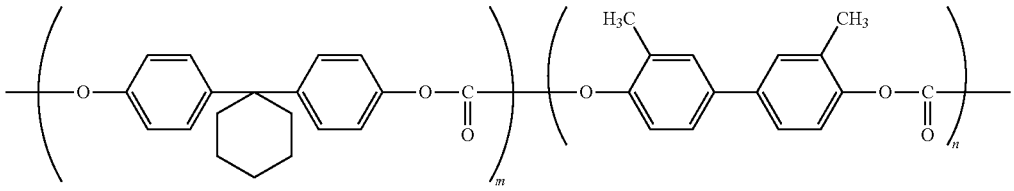

(B-4)

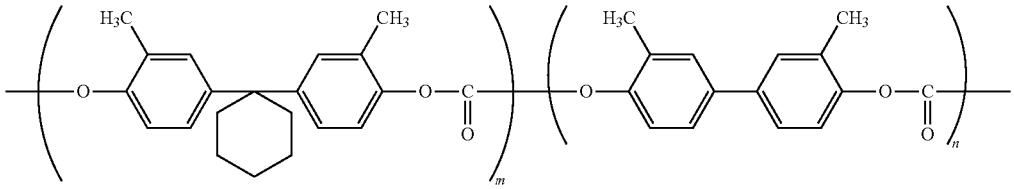

(B-5)

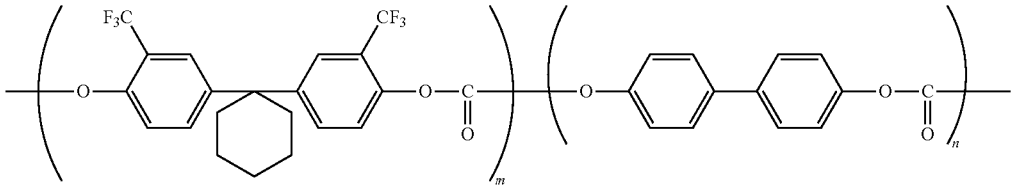

(B-6)

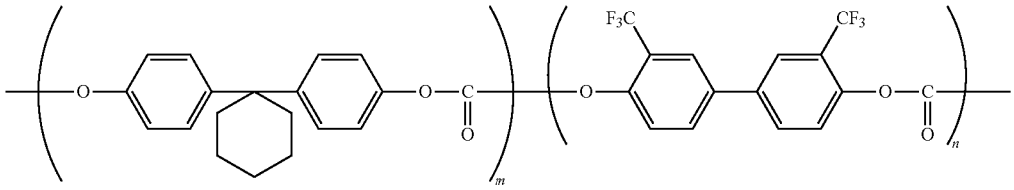

(B-7)

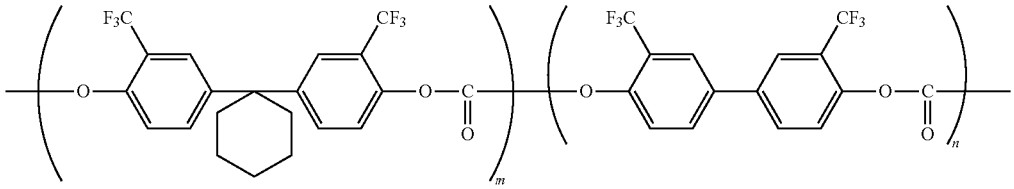

It is noted here that the ratio of m and n preferably satisfies $0.4 \leq n/(m+n) \leq 0.6$, and that a chain terminal group is preferably a monovalent aromatic group or a monovalent fluorine-containing aliphatic group.

In the charge transport layer 4, as required, other known binder resin(s) may also be used in combination within a range that does not markedly impair the effects of the present invention.

Examples of such other known binder resins include thermoplastic resins, such as polycarbonate resins other than the copolymerized polycarbonate resin represented by the General Formula (1), polyarylate resins, polyester resins, polyvinyl acetal resins, polyvinyl butyral resins, polyvinyl alcohol resins, vinyl chloride resins, vinyl acetate resins, polyethylene resins, polypropylene resins, polystyrene resins, acrylic resins, polyamide resins, ketone resins, polyacetal resins, polysulfone resins and methacrylate polymers; thermosetting resins, such as alkyd resins, epoxy resins, silicon resins, urea resins, phenol resins, unsaturated polyester resins, polyurethane resins and melamine resins; and copolymers of these resins, and these binder resins can be used individually, or in combination of two or more thereof as appropriate.

Specific examples of the compound having a structure represented by the General Formula (2) that is used as the hole transporting substance constituting the charge transport layer 4 include, but not limited to, the followings.

(H-1)
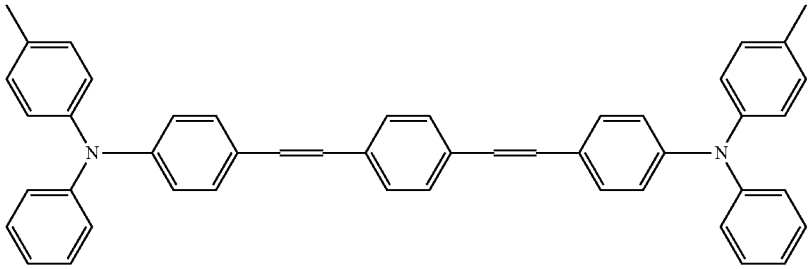
(H-2)
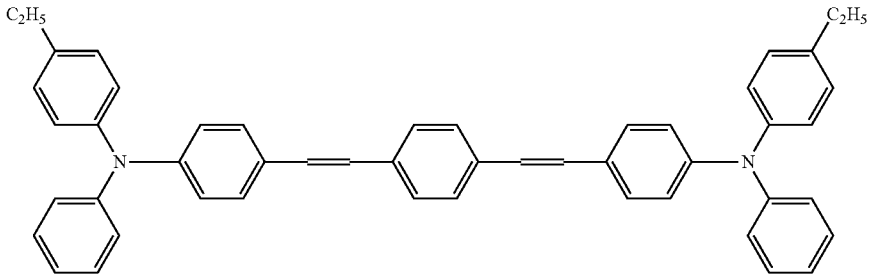
(H-3)
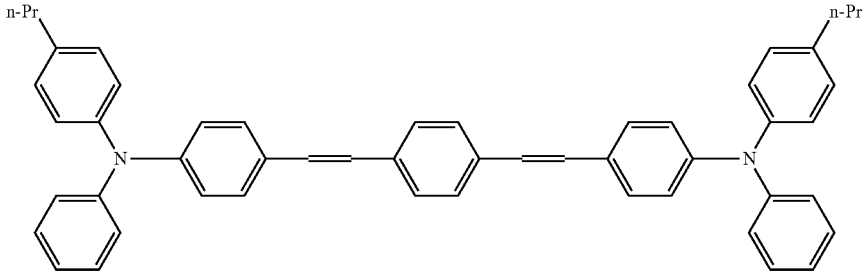
(H-4)
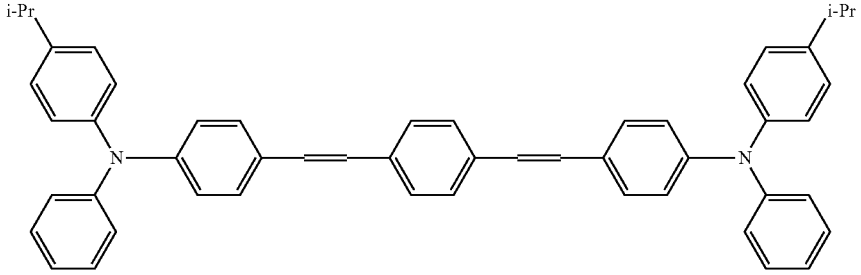
(H-5)
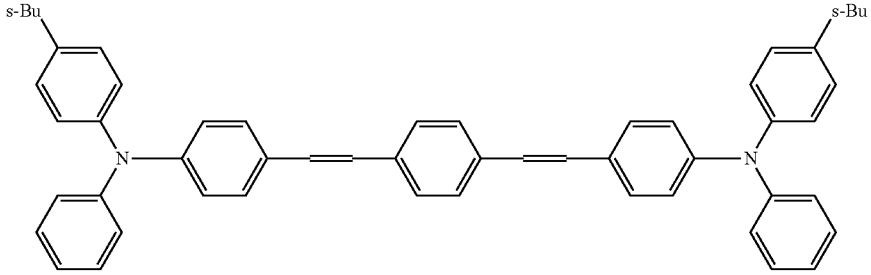

-continued
(H-6)
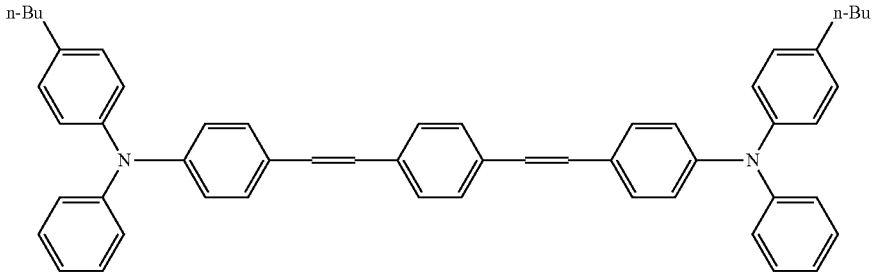
(H-7)
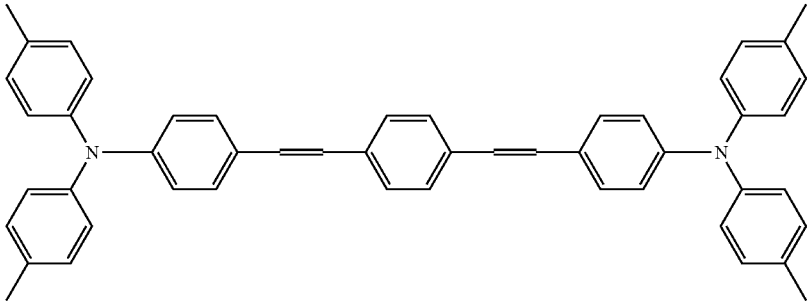
(H-8)
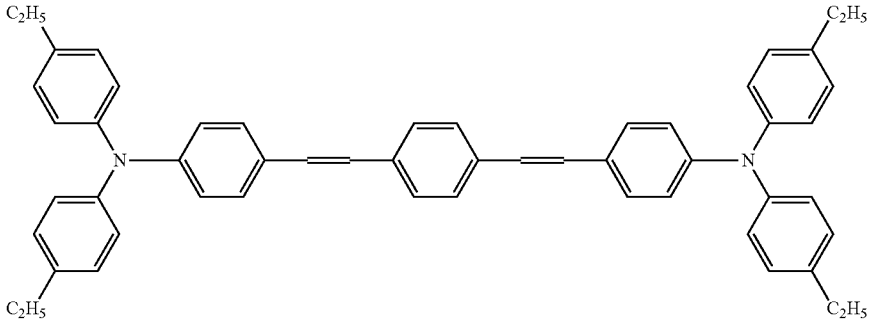
(H-9)
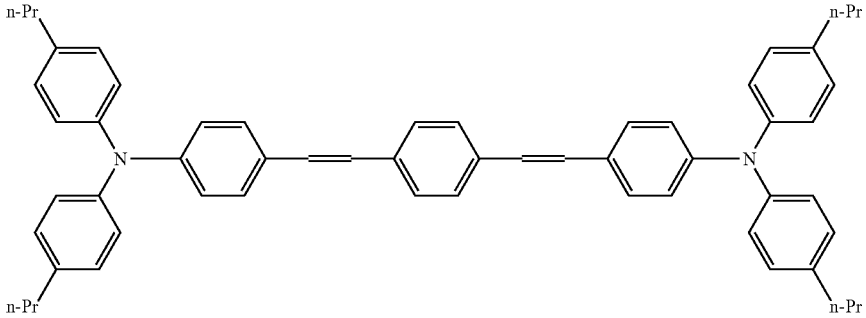
(H-10)
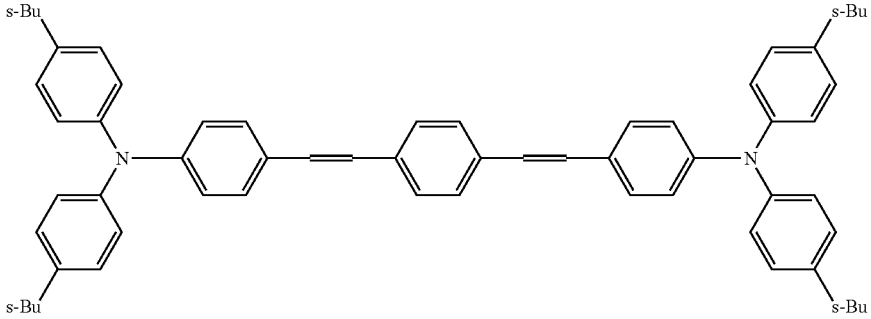

-continued
(H-11)
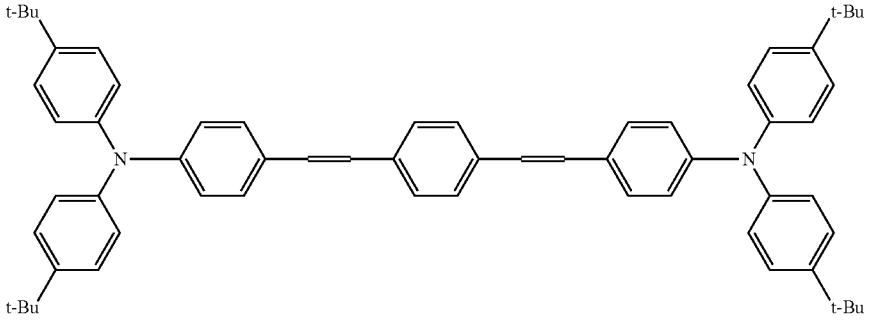
(H-12)
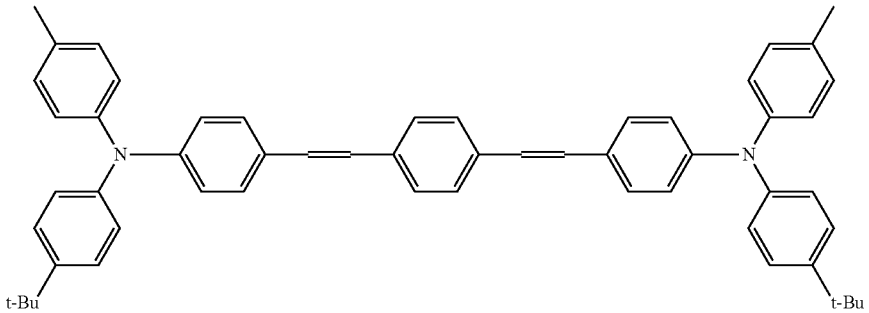
(H-13)
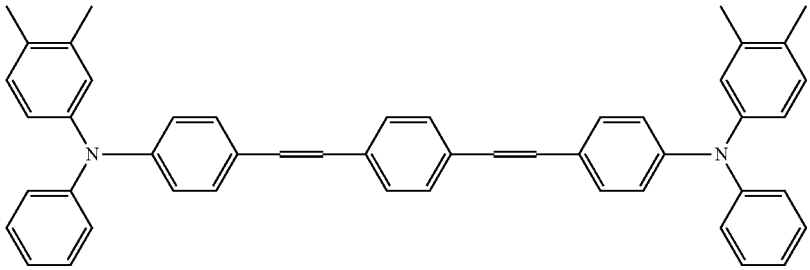
(H-14)
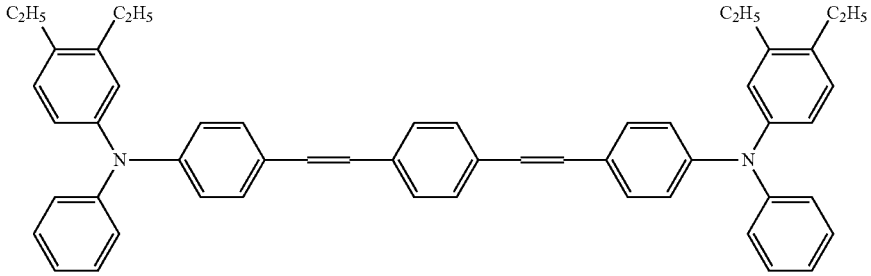
(H-15)
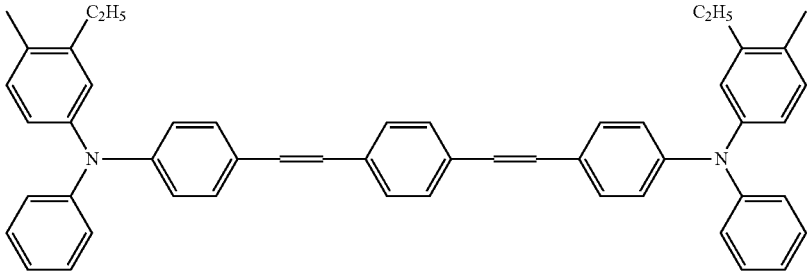

-continued
(H-16)
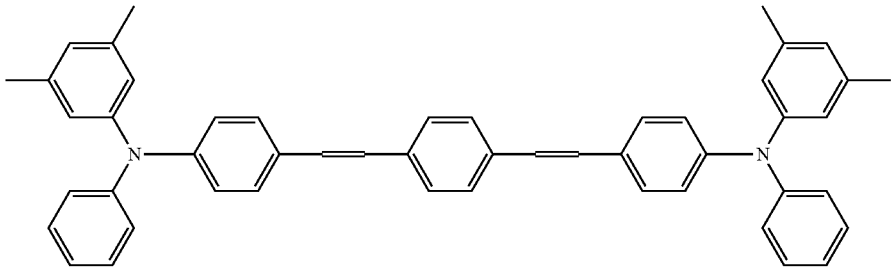
(H-17)
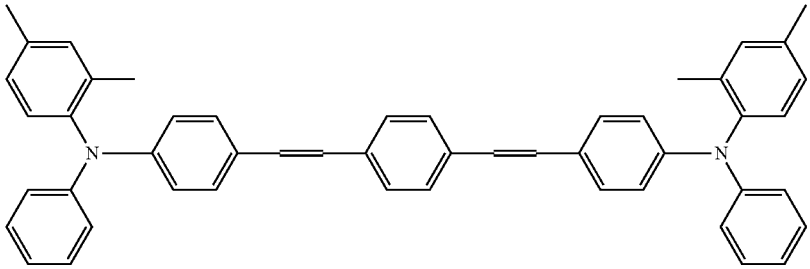
(H-18)
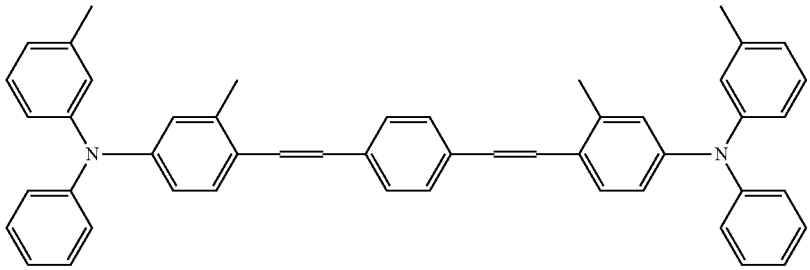
(H-19)
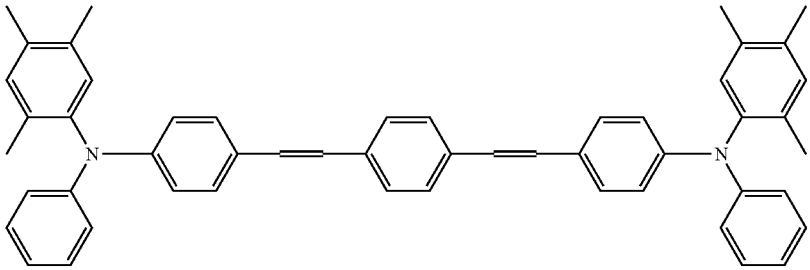
(H-20)
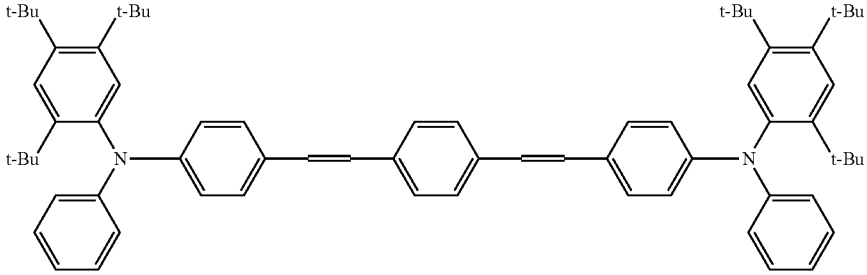

-continued
(H-21)
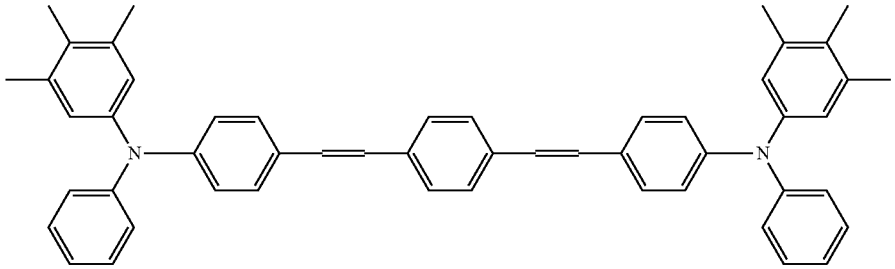
(H-22)
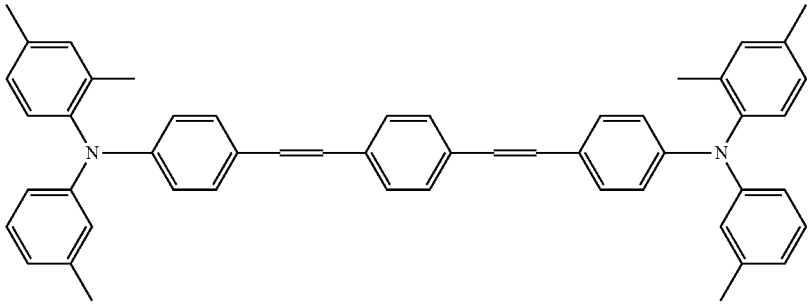
(H-23)
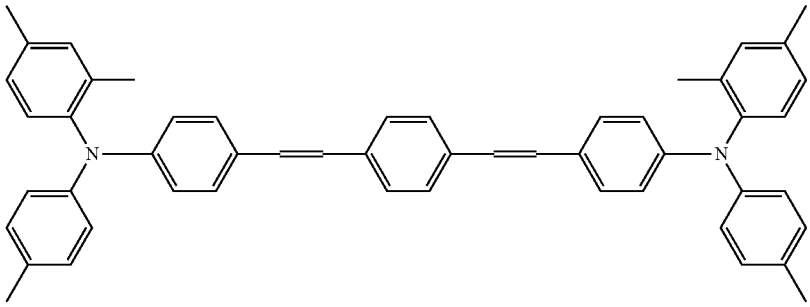
(H-24)
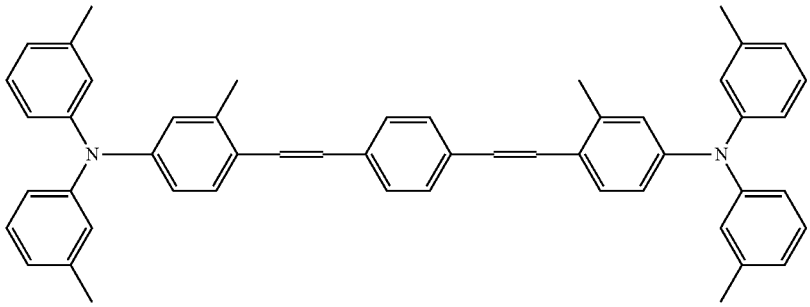
(H-25)
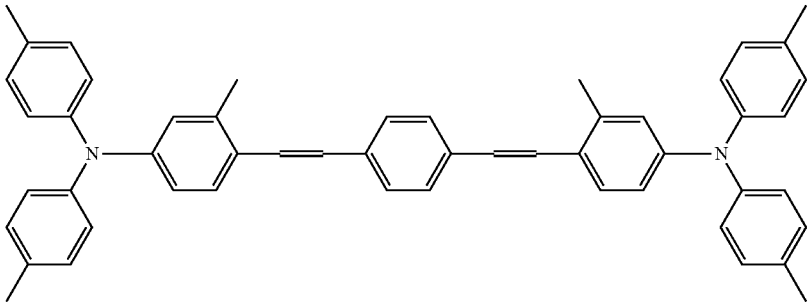

-continued
(H-26)
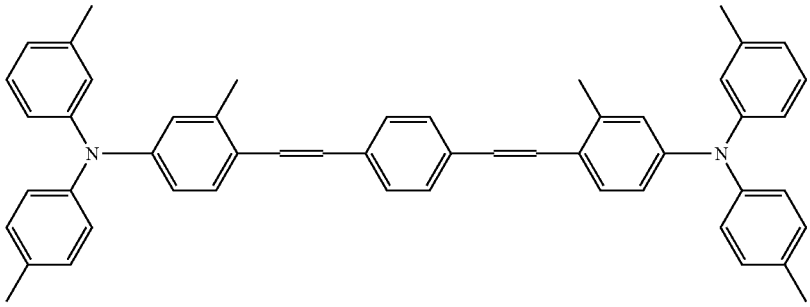
(H-27)
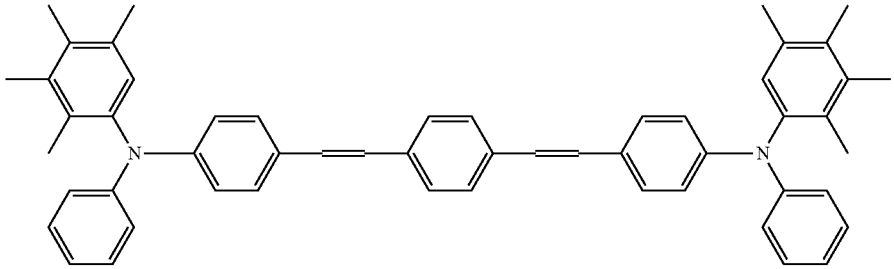
(H-28)
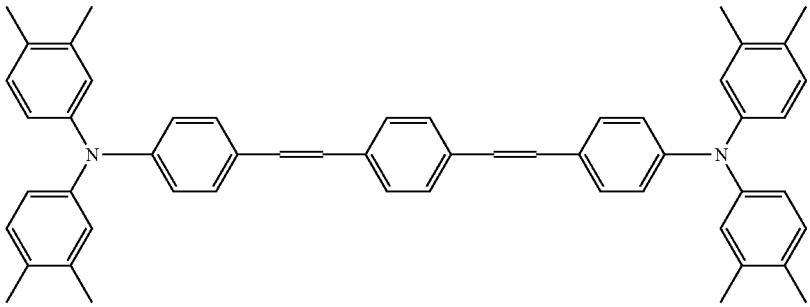
(H-29)
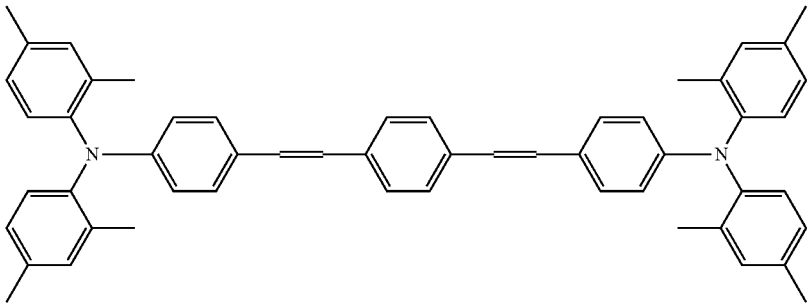
(H-30)
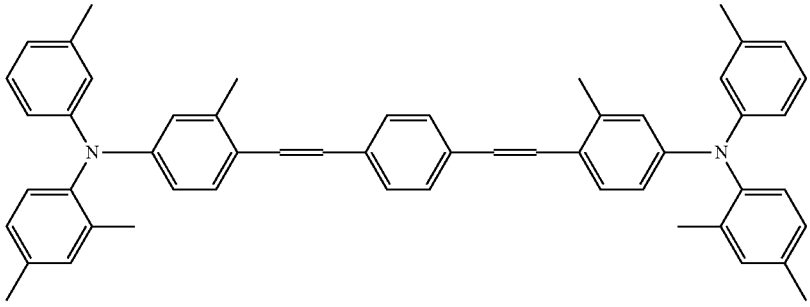

-continued
(H-31)
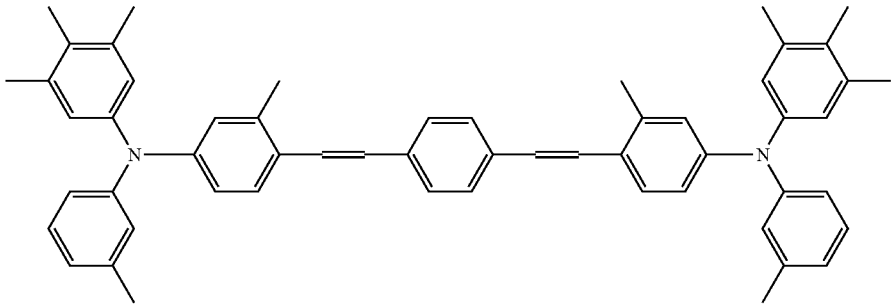
(H-32)
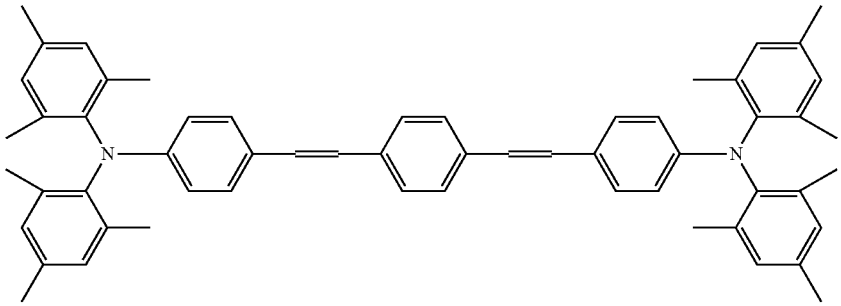
(H-33)
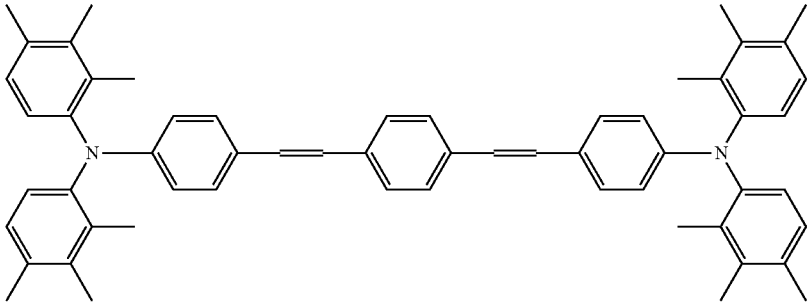
(H-34)
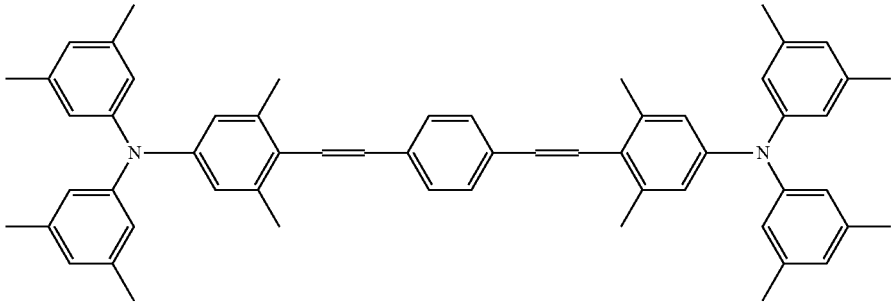
(H-35)
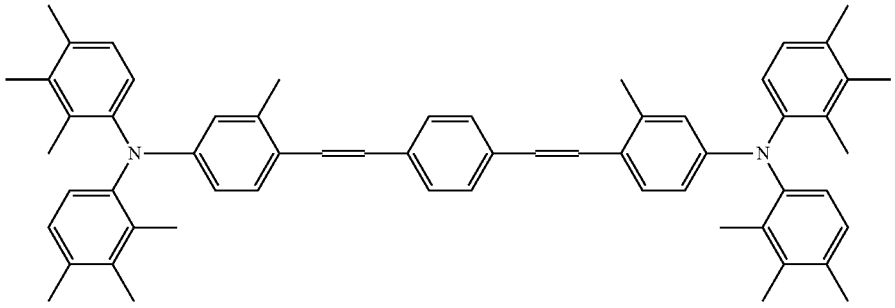

-continued
(H-36)
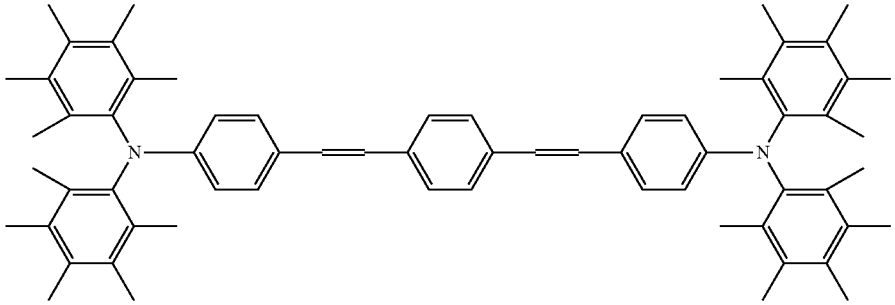
(H-37)
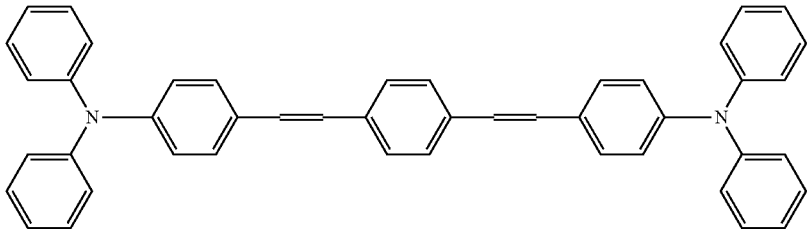
(H-38)
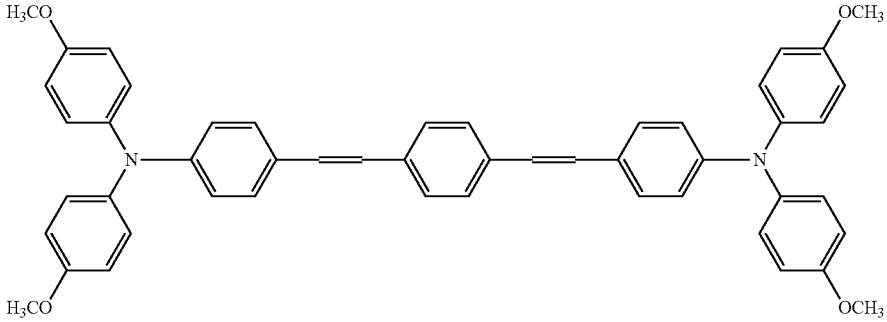
(H-39)
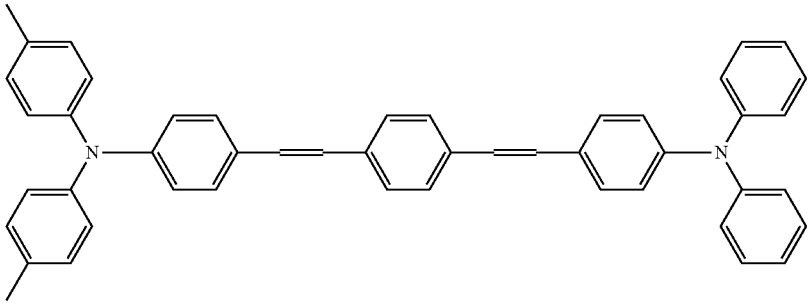
(H-40)
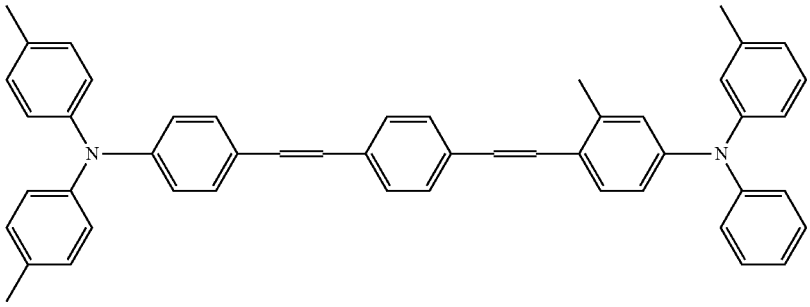

-continued
(H-41)
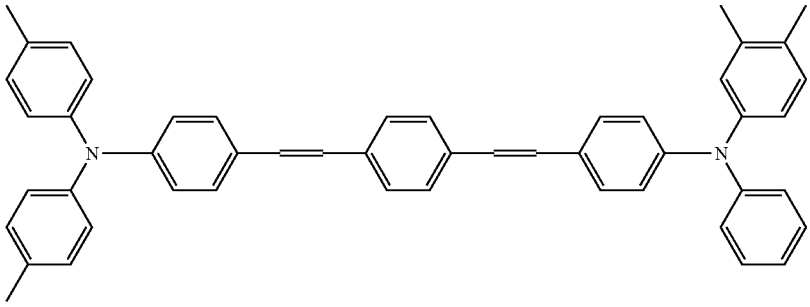
(H-42)
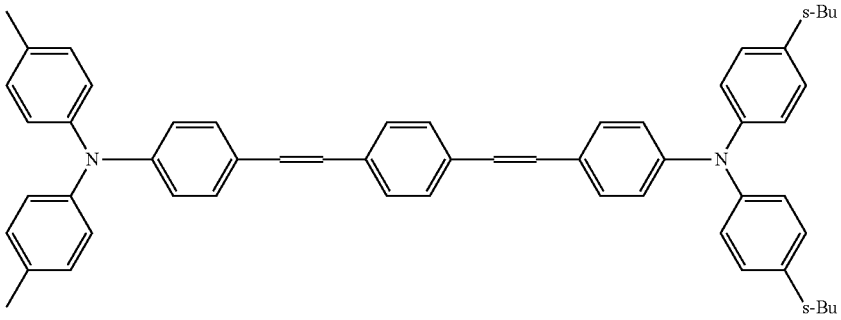
(H-43)
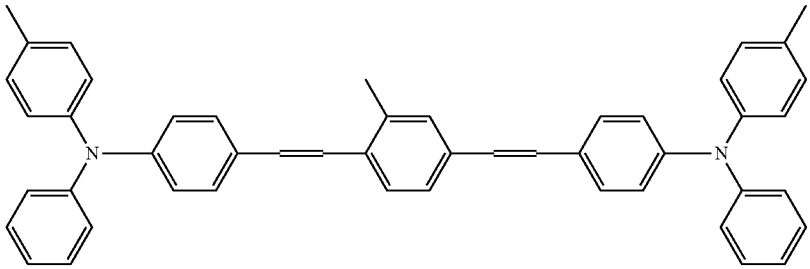
(H-44)
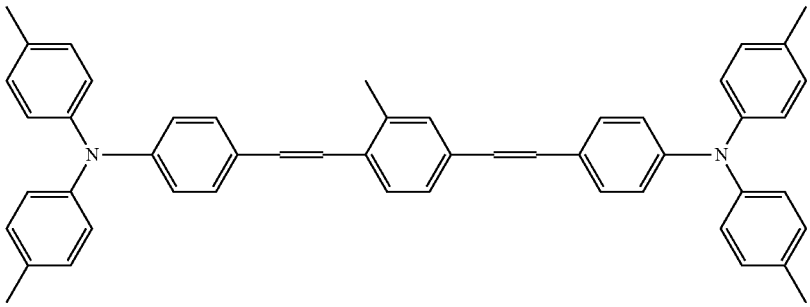
(H-45)
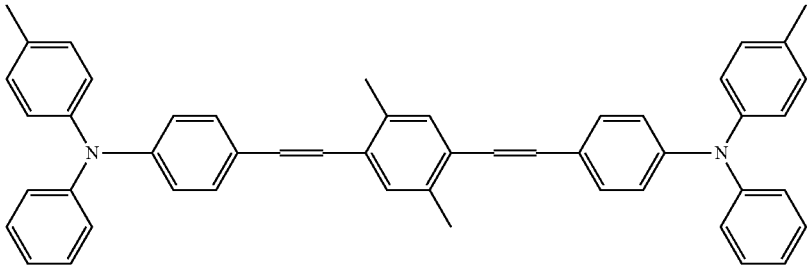

-continued (H-46)

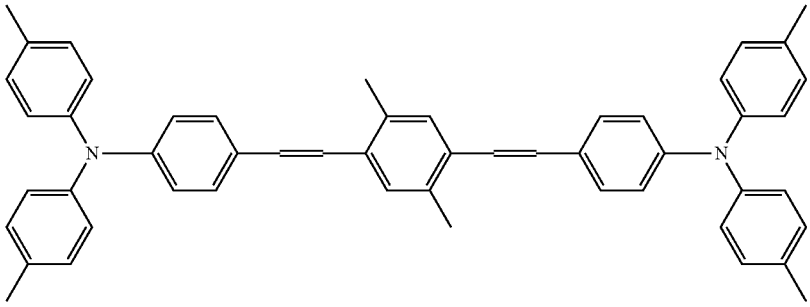

(H-47)

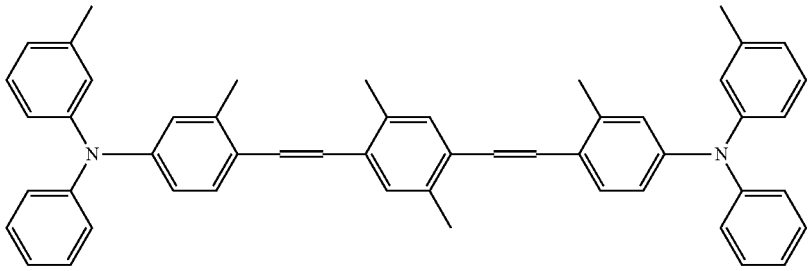

(H-48)

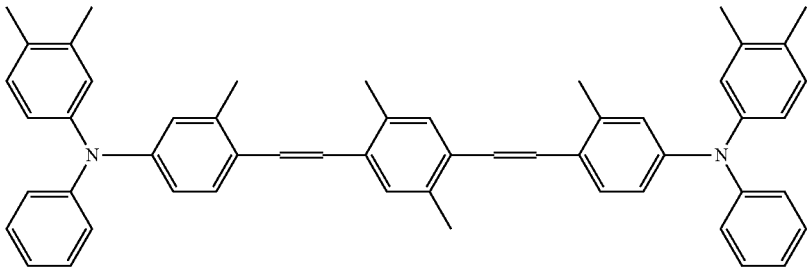

Further, in the charge transport layer 4, as required, other known hole transporting sub stance(s) may also be used in combination within a range that does not markedly impair the effects of the present invention.

Examples of such other known hole transporting substances include hydrazone compounds, pyrazoline compounds, pyrazolone compounds, oxadiazole compounds, oxazole compounds, arylamine compounds, benzidine compounds, stilbene compounds, styryl compounds, enamine compounds, butadiene compounds, polyvinyl carbazoles and polysilanes, and these compounds can be used individually, or in combination of two or more thereof as appropriate.

Specific examples of the compound having a structure represented by the General Formula (3) that is used as the electron transporting substance constituting the charge transport layer 4 include, but not limited to, the followings.

(E-1)

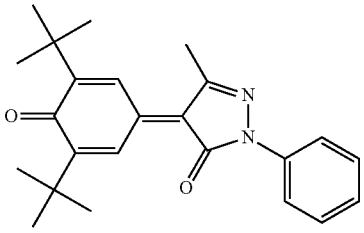

-continued (E-2)

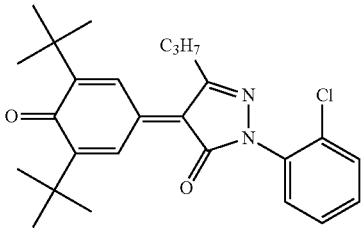

(E-3)

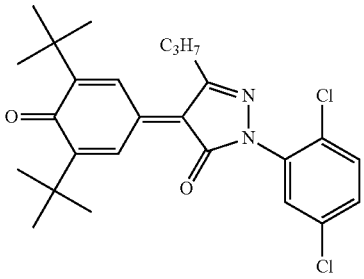

-continued (E-4)

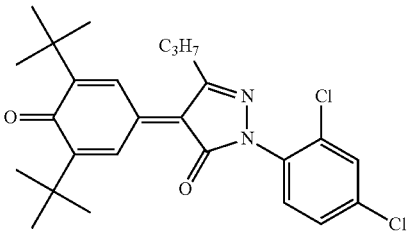

(E-5)

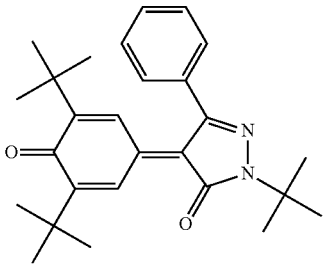

(E-6)

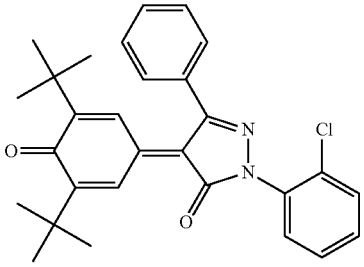

(E-7)

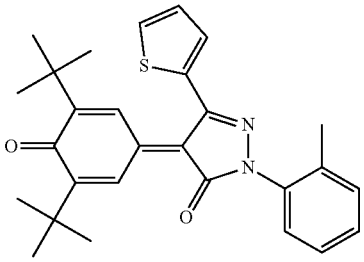

(E-8)

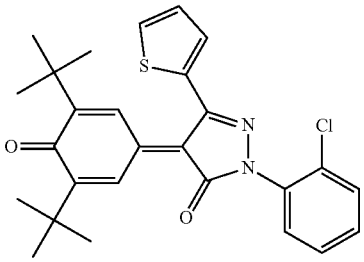

(E-9)

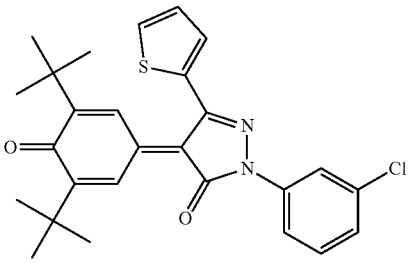

-continued (E-10)

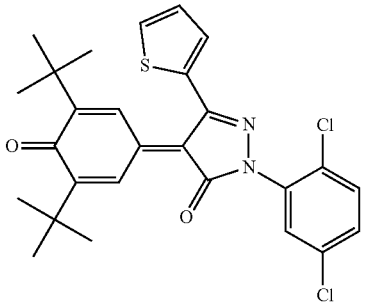

(E-11)

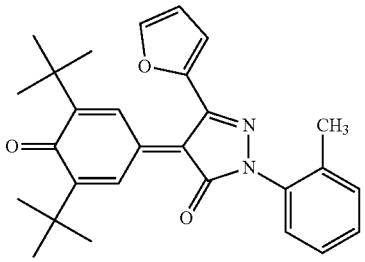

(E-12)

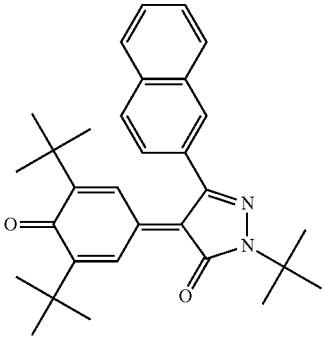

(E-13)

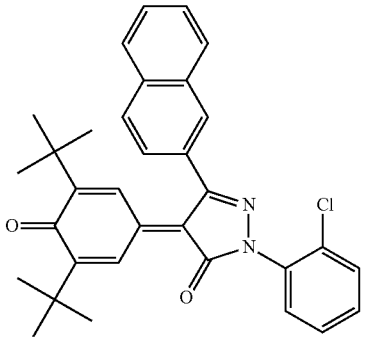

Moreover, in the charge transport layer 4, as required, other known electron transporting substance(s) may also be used in combination within a range that does not markedly impair the effects of the present invention.

Examples of such other known electron transporting substances include electron transporting substances (acceptor compounds) such as succinic anhydride, maleic anhydride, dibromosuccinic anhydride, phthalic anhydride, 3-nitrophthalic anhydride, 4-nitrophthalic anhydride, pyromellitic anhydride, pyromellitic acid, trimellitic acid, trimellitic anhydride, phthalimide, 4-nitrophthalimide, tetracyanoethylene, tetracyanoquinodimethane, chloranil, bromanil, o-nitrobenzoic acid, malononitrile, trinitrofluorenone, trinitrothioxanthone, dinitrobenzene, dinitroanthracene, dinitroacridine, nitroanthraquinone, dinitroanthraquinone, thiopyran compounds, quinone compounds, benzoquinone compounds, diphenoquinone compounds, naphthoquinone compounds, azoquinone compounds, anthraquinone compounds, diiminoquinone compounds and stilbenequinone compounds, and these compounds can be used individually, or in combination of two or more thereof as appropriate.

In the charge transport layer 4, in addition to the compound having a structure represented by the Structural Formula (4) as an antioxidant, a deterioration inhibitor(s) such as other known antioxidant, a radical capturing agent, a singlet quencher and/or a UV absorber may also be incorporated within a range that does not markedly impair the effects of the present invention for the purpose of improving the environmental resistance and the stability against damaging light. Examples of such compounds include chromanol derivatives such as tocopherol, as well as esterified compounds, polyarylalkane compounds, hydroquinone derivatives, etherified compounds, dietherified compounds, benzophenone derivatives, benzotriazole derivatives, thioether compounds, phenylenediamine derivatives, phosphonates, phosphites, phenolic compounds, hindered phenol compounds, linear amine compounds, cyclic amine compounds, hindered amine compounds, and biphenyl derivatives.

Further, in the charge transport layer 4, a leveling agent such as silicone oil or fluorocarbon oil can be incorporated for the purposes of improving the leveling property of the resulting film and imparting lubricity.

Moreover, for the purposes of reducing the frictional coefficient, imparting lubricity and the like, for example, fine particles of a metal oxide such as silicon oxide (silica), titanium oxide, zinc oxide, calcium oxide, aluminum oxide (alumina) or zirconium oxide, a metal sulfate such as barium sulfate or calcium sulfate or a metal nitride such as silicon nitride or aluminum nitride, or a fluororesin grains such as a tetrafluoroethylene resin or a comb-type graft fluoropolymer resin may also be incorporated.

The content of the binder resin in the charge transport layer 4 is preferably 18 to 89.9% by mass, more preferably 28.5 to 79.6% by mass, with respect to the solid content of the charge transport layer 4. The content of the hole transporting material in the charge transport layer 4 is preferably 10 to 72% by mass, more preferably 19.9 to 66.5% by mass, with respect to the solid content of the charge transport layer 4. The content of the electron transporting material in the charge transport layer 4 is preferably 0.05 to 5% by mass, more preferably 0.25 to 2.5% by mass, with respect to the solid content of the charge transport layer 4. The content of the antioxidant in the charge transport layer 4 is preferably 0.05 to 5% by mass, more preferably 0.25 to 2.5% by mass, with respect to the solid content of the charge transport layer 4.

In order to maintain a practically effective surface potential, the thickness of the charge transport layer 4 is preferably 5 to 60 more preferably 10 to 40 μm.

Method of Producing Electrophotographic Photoreceptor

In the production of a photoreceptor, the above-described charge generation layer and charge transport layer are formed by a dip coating method. By employing a dip coating method, a photoreceptor having good outer appearance quality and stable electrical properties can be produced while ensuring low cost and high productivity. For the production of such a photoreceptor, there is no particular restriction except for the use of a dip coating method, and the production can be carried out in accordance with a conventional method.

Specifically, first, an arbitrary charge generating material is dissolved and dispersed in a solvent along with an arbitrary binder resin and the like to prepare a coating liquid for formation of a charge generation layer. Next, a conductive substrate is immersed in this coating liquid for formation of a charge generation layer to coat the outer circumference of the conductive substrate with the coating liquid, after which the coating liquid is dried to form a charge generation layer. Prior to the formation of the charge generation layer, an intermediate layer may be formed as desired. Then, the predetermined binder resin, hole transporting substance, electron transporting substance, antioxidant and the like are dissolved in a solvent to prepare a coating liquid for formation of a charge transport layer. The conductive substrate on which the charge generation layer has been formed is immersed in this coating liquid to apply the coating liquid for a charge transport layer onto the charge generation layer, after which the thus applied coating liquid is dried to form a charge transport layer. In this manner, a photoreceptor can be produced. It is noted here that the types of the solvents used for the preparation of the coating liquids, the coating conditions, the drying conditions and the like can be selected as appropriate in accordance with a conventional method and are not particularly restricted.

Electrophotographic Device

The electrophotographic device includes: the above-described photoreceptor; a charging means (charging element) for charging the photoreceptor; an exposure means (exposure element) for exposing the thus charged photoreceptor to form an electrostatic latent image; a developing means (developing element) for developing the electrostatic latent image formed on a surface of the photoreceptor with a toner to form a toner image; a transfer means (transfer element) for transferring the toner image formed on the surface of the photoreceptor to a recording medium; and a fixation means (fixation element) for fixing the toner image transferred to the recording medium.

Figure 2:
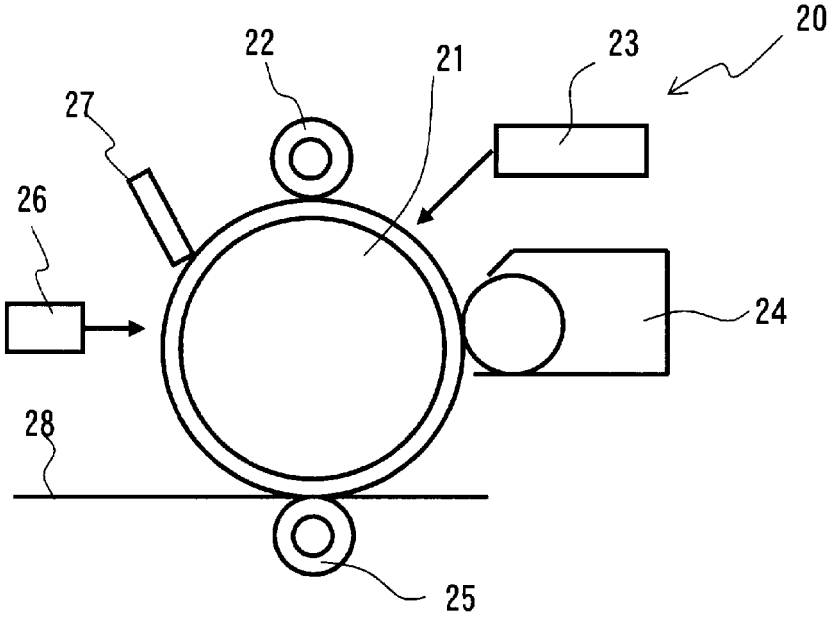
FIG. 2 is a schematic explanatory view showing an example of the electrophotographic device of the present invention.

FIG. 2 is a schematic structural view illustrating one example of the electrophotographic apparatus of the present invention. An illustrated electrophotographic aperture (device) 20 includes: a charging roller 22 as a charging device, which is arranged on the outer periphery of a photoreceptor 21; a laser optical system for exposure 23 as an exposure device; a developer 24 as a developing device; a transfer roller 25 as a transfer device; and a fixation device (not illustrated), and the electrophotographic device 20 can be configured as a color printer. In the drawing, reference numerals 26, 27 and 28 represent a light source for charge removal, a cleaning blade and a sheet of paper, respectively.

EXAMPLES

The present invention will now be described in detail by way of Examples thereof. As long as the present invention does not depart from the gist thereof, the present invention is not restricted to the descriptions of the following Examples.

Example 1

A coating liquid for formation of an intermediate layer was prepared by dissolving or dispersing 15 parts by mass of p-vinylphenol resin (trade name: MARUKA LYNCUR MH-2, manufactured by Maruzen Petrochemical Co., Ltd.), 10 parts by mass of n-butylated melamine resin (trade name: U-VAN 2021, manufactured by Mitsui Chemicals, Inc.) and 75 parts by mass of aminosilane-treated titanium oxide fine particles in a mixed solvent of 750 parts by mass of methanol and 150 parts by mass of butanol. In the thus obtained coating liquid for formation of an intermediate layer, an aluminum alloy substrate having an outer diameter of 30 mm and a length of 255 mm was immersed and subsequently pulled out, whereby a coating film was formed on the outer circumference of the substrate. This substrate was dried at a temperature of 140° C. for 30 minutes to form a 3 μm-thick intermediate layer.

Next, a coating liquid for formation of a charge generation layer was prepared by dispersing 15 parts by mass of Y-type titanyl phthalocyanine described in Japanese Unexamined Patent Application Publication No. S64-17066 or U.S. Pat. No. 4,898,799 as a charge generating material and 15 parts by mass of polyvinyl butyral (S-LEC B BX-1, manufactured by Sekisui Chemical Co., Ltd.) as a binder resin in 600 parts by mass of dichloromethane for 1 hour using a sand mill disperser. The thus obtained coating liquid for formation of a charge generation layer was dip-coated on the above-formed intermediate layer. The resulting substrate was dried at a temperature of 80° C. for 30 minutes to form a 0.3 μm-thick charge generation layer.

Then, as a binder resin, a hole transporting substance, an electron transporting substance and an antioxidant, 140 parts by mass of a copolymerized polycarbonate resin having a mass-average molecular weight of 50,000 represented by the Structural Formula (B-3) where n/(m+n)=0.4 and a terminal group is represented by Structural Formula (6) below:

(6)

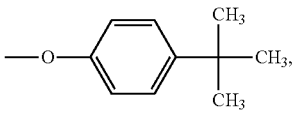

60 parts by mass of a compound represented by the Structural Formula (H-23), 5 parts by mass of a compound represented by the Structural Formula (E-3) and 5 parts by mass of a compound represented by the Structural Formula (4), respectively, were dissolved in 900 parts by mass of tetrahydrofuran, and 3 parts by mass of silicone oil (KP-340, manufactured by Shin-Etsu Polymer Co., Ltd.) was subsequently added to the resultant to prepare a coating liquid for formation of a charge transport layer. The thus obtained coating liquid for formation of a charge transport layer was dip-coated on the charge generation layer. The resulting substrate was dried at a temperature of 120° C. for 60 minutes to form a 30 μm-thick charge transport layer, whereby an electrophotographic photoreceptor was prepared.

It is noted here that, in this process, the mass ratio H/(B+H) between the mass (B) of the binder resin and the mass (H) of the hole transporting substance was 30% by mass.

Examples 2 to 6 and Comparative Examples 1 to 15

Electrophotographic photoreceptors were each prepared in the same manner as in Example 1, except that the types and added amounts of the binder resin, hole transporting substance, electron transporting substance and antioxidant of the charge transport layer were changed as shown in Table 1 below. Structural Formulae of the materials in Table 1 are shown below. In Table 1, "parts" represent "parts by mass".

(BD1)

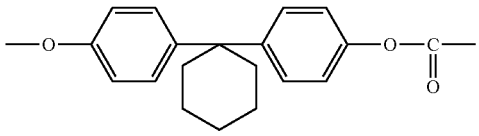

(BD2)

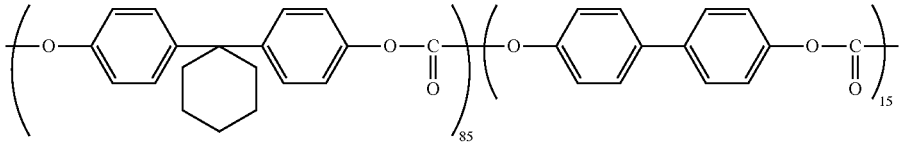

(BD3)

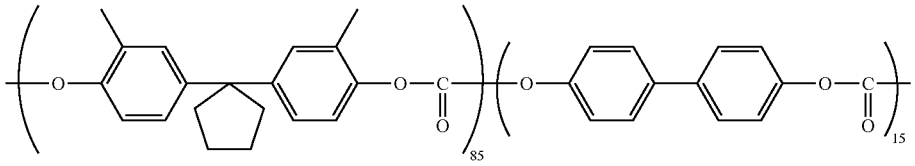

-continued (HT1)

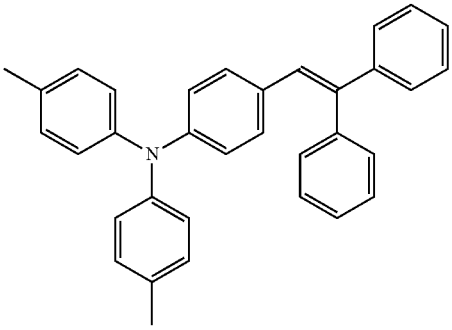

(HT2)

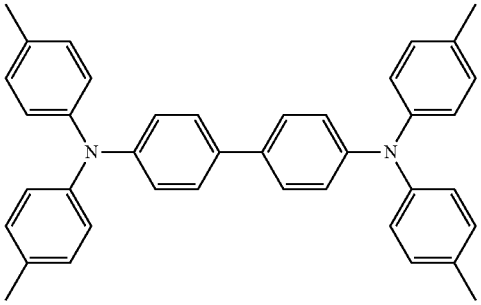

(ET1)

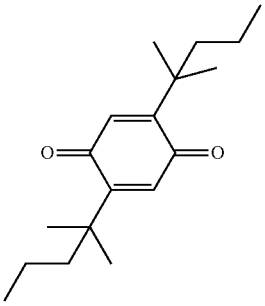

(ET2)

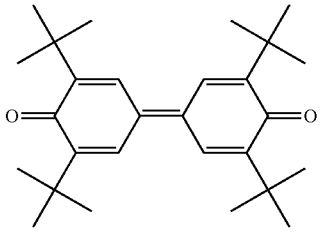

(ET3)

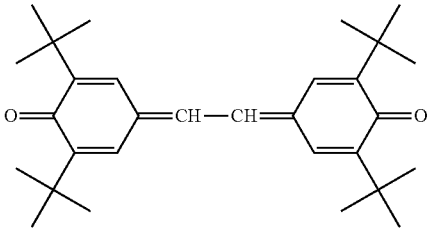

(AO1)

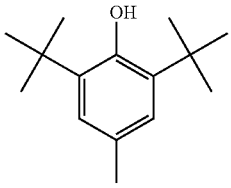

(AO2)

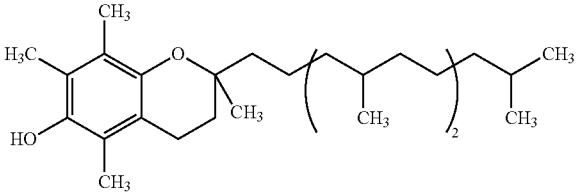

TABLE 1

| | Binder resin (B) | | Hole transporting substance (H) | | Electron transporting substance | | Antioxidant | | Mass ratio |
|---|---|---|---|---|---|---|---|---|---|
| | Structural formula | Added amount | Structural formula | Added amount | Structural formula | Added amount | Structural formula | Added amount | H/(B + H) (%) |
| Example 1 | B-3 | 140 parts | H-23 | 60 parts | E-3 | 5 parts | 4 | 5 parts | 30 |
| Example 2 | B-3 | 130 parts | H-23 | 70 parts | E-3 | 5 parts | 4 | 5 parts | 35 |
| Example 3 | B-3 | 160 parts | H-23 | 40 parts | E-3 | 5 parts | 4 | 5 parts | 20 |
| Example 4 | B-1 | 140 parts | H-23 | 60 parts | E-3 | 5 parts | 4 | 5 parts | 30 |
| Example 5 | B-3 | 140 parts | H-7 | 60 parts | E-3 | 5 parts | 4 | 5 parts | 30 |
| Example 6 | B-3 | 140 parts | H-23 | 60 parts | E-4 | 5 parts | 4 | 5 parts | 30 |
| Comparative Example 1 | B-3 | 120 parts | H-23 | 80 parts | E-3 | 5 parts | 4 | 5 parts | 40 |
| Comparative Example 2 | B-3 | 170 parts | H-23 | 30 parts | E-3 | 5 parts | 4 | 5 parts | 15 |
| Comparative Example 3 | BD1 | 140 parts | H-23 | 60 parts | E-3 | 5 parts | 4 | 5 parts | 30 |
| Comparative Example 4 | BD2 | 140 parts | H-23 | 60 parts | E-3 | 5 parts | 4 | 5 parts | 30 |

TABLE 1-continued

| | Binder resin (B) | | Hole transporting substance (H) | | Electron transporting substance | | Antioxidant | | Mass ratio |
|---|---|---|---|---|---|---|---|---|---|
| | Structural formula | Added amount | Structural formula | Added amount | Structural formula | Added amount | Structural formula | Added amount | H/(B + H) (%) |
| Comparative Example 5 | BD3 | 140 parts | H-23 | 60 parts | E-3 | 5 parts | 4 | 5 parts | 30 |
| Comparative Example 6 | B-3 | 140 parts | HT1 | 60 parts | E-3 | 5 parts | 4 | 5 parts | 30 |
| Comparative Example 7 | B-3 | 140 parts | HT2 | 60 parts | E-3 | 5 parts | 4 | 5 parts | 30 |
| Comparative Example 8 | B-3 | 140 parts | H-23 | 60 parts | ET1 | 5 parts | 4 | 5 parts | 30 |
| Comparative Example 9 | B-3 | 140 parts | H-23 | 60 parts | ET2 | 5 parts | 4 | 5 parts | 30 |
| Comparative Example 10 | B-3 | 140 parts | H-23 | 60 parts | ET3 | 5 parts | 4 | 5 parts | 30 |
| Comparative Example 11 | B-3 | 140 parts | H-23 | 60 parts | — | — | 4 | 5 parts | 30 |
| Comparative Example 12 | B-3 | 140 parts | H-23 | 60 parts | E-3 | 5 parts | AO1 | 5 parts | 30 |
| Comparative Example 13 | B-3 | 140 parts | H-23 | 60 parts | E-3 | 5 parts | AO2 | 5 parts | 30 |
| Comparative Example 14 | B-3 | 140 parts | H-23 | 60 parts | E-3 | 5 parts | — | — | 30 |
| Comparative Example 15 | B-3 | 140 parts | H-23 | 60 parts | — | — | — | — | 30 |

For each of the electrophotographic photoreceptors prepared in Examples 1 to 6 and Comparative Examples 1 to 15, the electrical properties, the amount of wear and the print density in a 30,000-print evaluation, the repeated-use bright area potential stability, and the light resistance were evaluated in accordance with the following evaluation methods.

Evaluation of Electrical Properties:

First, using a photoreceptor electrical property tester CYNTHIA 93FE (manufactured by Gen-Tech, Inc.) whose angle arrangement and photoreceptor rotation speed were set such that the migration time from exposure to the potential measuring probe was 67 ms, each photoreceptor was charged with a surface potential (Vo) of −600 V while adjusting the applied voltage by a scorotron charging method under an environment having a temperature of 23° C. and a relative humidity of 50%. Subsequently, using a halogen lamp as a light source, the photoreceptor was sequentially exposed to a monochromatic light spectrally resolved to 780 nm through a band-pass filter while changing the exposure dose, and the surface potential was measured at each exposure dose. From the resulting light attenuation curve, the exposure dose required for the half-tone potential (Vh) to reach −300 V was determined as the sensitivity E1/2 ($\mu J/cm^2$) and, similarly, the potential of the surface irradiated at an exposure dose of 0.6 $\mu J/cm^2$ was determined as the bright area potential Vr (−V).

Evaluation of Amount of Wear:

After measuring the initial thickness of the photosensitive layer, each photoreceptor was mounted on a color printer CLX-8640ND (manufactured by Samsung Electronics Co., Ltd.), and 30,000 sheets of A4-sized paper were side-to-side printed under an environment having a temperature of 23° C. and a relative humidity of 50%. After the completion of printing evaluation, the thickness of the photosensitive layer was measured again, and the amount of wear was determined from the difference between the initial thickness and the post-printing thickness of the photosensitive layer. An evaluation of "○" was given when the amount of wear was 3 μm or less; an evaluation of "Δ" was given when the amount of wear was larger than 3 μm but 5 μm or less; and an evaluation of "x" was given when the amount of wear was larger than 5 μm.

Evaluation of Print Density:

Simultaneously with the evaluation of the amount of wear, each photoreceptor was mounted on a color printer CLX-8640ND (manufactured by Samsung Electronics Co., Ltd.), and 30,000 sheets of A4-sized paper were side-to-side printed under an environment having a temperature of 23° C. and a relative humidity of 50%, after which a black 100% image was output and the print density was measured. An evaluation of "○" was given when the print density was 1.3 or higher; an evaluation of "Δ" was given when the print density was below 1.3 but 1.2 or higher; and an evaluation of "x" was given when the print density was below 1.2.

Evaluation of Repeated-Use Bright Area Potential Stability

Using a photoreceptor electrical property tester CYNTHIA 93FE (manufactured by Gen-Tech, Inc.) set to have the same processing conditions as in the evaluation of electrical properties, a process of charging, exposure and charge removal was repeated 2,000 times under an environment having a temperature of 32° C. and a relative humidity of 80%, and the bright area potential (VL) was measured before and after the repeated processes to determine the change in bright area potential (ΔVL). An evaluation of "○" was given when the change in bright area potential (ΔVL) was 60 V or less; an evaluation of "Δ" was given when the change in bright area potential (ΔVL) was greater than 60 V but 100 V or less; and an evaluation of "x" was given when the change in bright area potential (ΔVL) was greater than 100 V.

Evaluation of Light Resistance:

Photoreceptors different from the ones used for the above-described evaluations were each covered with a sheet of black paper having an opening formed on the part to be irradiated with light, and then irradiated for 10 minutes with light of a white fluorescent lamp adjusted at a luminous intensity of 500 lx. Immediately after the completion of the irradiation, each photoreceptor was mounted on a color printer CLX-8640ND (manufactured by Samsung Electronics Co., Ltd.), and a black 45% half-tone image was output to measure the difference in print density between the light-irradiated part and the non-irradiated part. An evaluation of "○" was given when the difference in print density was 0.03 or smaller; an evaluation of "Δ" was given when the difference in print density was larger than 0.03 but 0.06 or smaller; and an evaluation of "x" was given when the difference in print density was larger than 0.06.

The thus obtained results are shown in Table 2 below.

TABLE 2

| | Electrical properties | | Amount | Print density after | Change in bright area | Light |
|---|---|---|---|---|---|---|
| | E½ (μJ/cm²) | Vr (−V) | of wear | 30,000 prints | potential ΔVL (V) | resistance |
| Example 1 | 0.10 | 81 | ○ | ○ | ○ | ○ |
| Example 2 | 0.09 | 72 | ○ | ○ | ○ | ○ |
| Example 3 | 0.12 | 95 | ○ | ○ | ○ | ○ |
| Example 4 | 0.10 | 77 | ○ | ○ | ○ | ○ |
| Example 5 | 0.11 | 84 | ○ | ○ | ○ | ○ |
| Example 6 | 0.10 | 79 | ○ | ○ | ○ | ○ |
| Comparative Example 1 | 0.08 | 64 | x | ○ | ○ | Δ |
| Comparative Example 2 | 0.15 | 153 | ○ | x | x | ○ |
| Comparative Example 3 | 0.09 | 71 | x | Δ | ○ | ○ |
| Comparative Example 4 | 0.10 | 76 | x | ○ | ○ | ○ |
| Comparative Example 5 | 0.12 | 82 | x | Δ | Δ | ○ |
| Comparative Example 6 | 0.15 | 168 | ○ | x | x | ○ |
| Comparative Example 7 | 0.14 | 134 | ○ | x | x | Δ |
| Comparative Example 8 | 0.12 | 129 | ○ | x | Δ | x |
| Comparative Example 9 | 0.11 | 102 | ○ | x | x | ○ |
| Comparative Example 10 | 0.11 | 98 | ○ | x | x | ○ |
| Comparative Example 11 | 0.10 | 73 | ○ | Δ | ○ | x |
| Comparative Example 12 | 0.12 | 102 | ○ | x | Δ | ○ |
| Comparative Example 13 | 0.18 | 214 | ○ | x | x | x |
| Comparative Example 14 | 0.10 | 72 | Δ | Δ | Δ | Δ |
| Comparative Example 15 | 0.09 | 67 | Δ | x | Δ | x |

From the results shown above, in the photoreceptors of Examples in which the charge transport layer contained a specific binder resin, hole transporting substance, electron transporting substance and antioxidant and the mass ratio H/(B+H) of the binder resin (B) and the hole transporting substance (H) satisfied a predetermined condition, it was confirmed that the photoreceptors attained excellent wear resistance without a notable adverse effect on the electrophotographic properties and the light resistance, such as a reduction in sensitivity or an increase in residual potential, and can provide a stable print quality in actual use.

On the other hand, in Comparative Example 1 where the mass ratio H/(B+H) was higher than 35% by mass and Comparative Examples 3, 4 and 5 where a binder resin other than the one represented by the General Formula (1) was used (BD1, BD2 and BD3, respectively), the amount of wear exceeded 5 μm, and these photoreceptors did not have a sufficient printing life. Moreover, in Comparative Example 2 where the mass ratio H/(B+H) was lower than 20% by mass, Comparative Examples 6 and 7 where a hole transporting substance other than the one represented by the General Formula (2) was used (HT1 and HT2, respectively), Comparative Examples 8, 9 and 10 where an electron transporting substance other than the one represented by the General Formula (3) was used (ET1, ET2 and ET3, respectively), Comparative Examples 12 and 13 where an antioxidant other than the one represented by the Structural Formula (4) was used (AO1 and AO2, respectively), and Comparative Examples 11, 14 and 15 which did not contain either or both of the electron transporting substance of the General Formula (3) and the antioxidant of the Structural Formula (4), deteriorations of the electrical properties that adversely affect the print quality, such as an increase in the change in bright area potential (ΔVL) and a prominent reduction in light resistance, were observed, and a reduction in print density was confirmed also in the actual print evaluation.

As described above, according to the present invention, by using specific binder resin, hole transporting substance, electron transporting substance and antioxidant and controlling the mass ratio of the binder resin (B) and the hole transporting substance (H) to satisfy a predetermined condition, an electrophotographic photoreceptor and an image-forming device which, even without a surface protective layer being arranged on a charge transport layer, not only show excellent wear resistance while maintaining high sensitivity but also exhibit excellent stability in repeated use and light resistance and have excellent mass producibility, can be provided inexpensively.

What is claimed is:

1. An electrophotographic photoreceptor that is a negatively-chargeable laminate-type electrophotographic photoreceptor, comprising:

a conductive substrate;

a charge generation layer that is provided on the conductive substrate and that includes a charge generating material; and a charge transport layer that is provided on the charge generation layer and that comprises:

as a binder resin, a copolymerized polycarbonate resin having a repeating unit represented by General Formula (1) below:

(1)

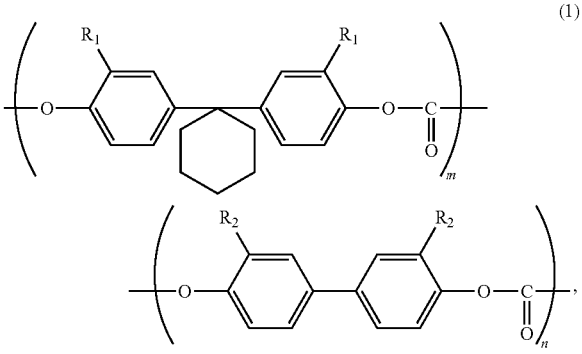

where $R_1$ and $R_2$ are the same or different and each represents a hydrogen atom, an alkyl group having 1 to 10 carbon atoms, or a fluoroalkyl group having 1 to 10 carbon atoms; n and m are both integers, a sum of m+n is 100, and n and m satisfy $0.4 \leq n/(m+n) \leq 0.6$; and a terminal group is represented by Structural Formula (6) below;

as a hole transporting substance, a compound having a structure represented by General Formula (2) below:

(2)

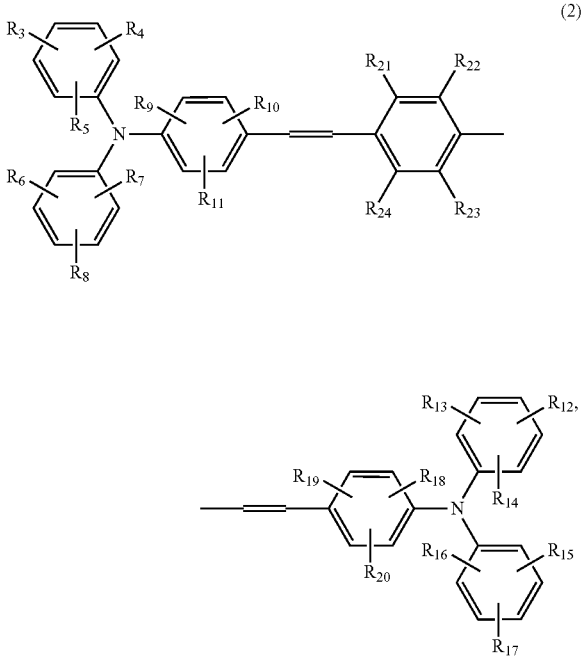

where $R_3$ to $R_{24}$ are the same or different and each represents a hydrogen atom, a lower alkyl group, a lower alkoxy group, an aryl group, or an aryl group-substituted alkenyl group;

as an electron transporting substance, a compound having a structure represented by General Formula (3) below:

(3)

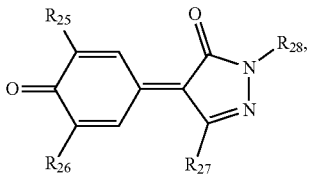

where $R_{25}$ to $R_{28}$ are the same or different and each represents a hydrogen atom, a lower alkyl group, a halogen atom, a cyano group, a nitro group, an aryl group optionally having a substituent, or a heterocyclic group optionally having a substituent; and as an antioxidant, a compound represented by Structural Formula (4) below:

(4)

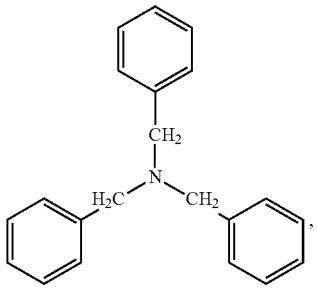

and wherein a mass ratio H/(B+H) represents a ratio of mass (H) of the hole transporting substance with respect to a sum of mass (B) of the binder resin and the mass (H) of the hole transporting substance in the charge transport layer, and satisfies Formula (5) below:

$$0.20 \leq H/(B+H) \leq 0.35 \quad (5); \text{ and}$$

(6)

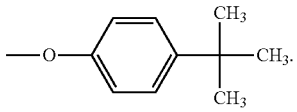

2. A method of producing the electrophotographic photoreceptor according to claim 1, comprising:

sequentially forming the charge generation layer and the charge transport layer by repeated dip coating and drying.

3. A method of producing the electrophotographic photoreceptor according to claim 1, comprising:

providing a first coating solution including materials for the charge generation layer;

dip coating the conductive substrate into the first coating solution to provide a first coating on the substrate;

drying the first coating to provide the charge generation layer;

providing a second coating solution including materials for the charge transport layer;

dip coating the charge generation layer into the second coating solution to provide a second coating on the charge generation layer; and drying the second coating to provide the charge transport layer.

4. The method of producing the electrophotographic photoreceptor according to claim 3, wherein drying is accomplished by air drying at ambient temperature and pressure, or drying in a vacuum with or without heating, or drying with heat at ambient pressure.

5. An electrophotographic apparatus, comprising:

the electrophotographic photoreceptor according to claim 1;

a charging devise for charging the electrophotographic photoreceptor;

an exposure device for exposing the electrophotographic photoreceptor after charging to form an electrostatic latent image;

a developing device for developing the electrostatic latent image formed on a surface of the electrophotographic photoreceptor with a toner to form a toner image; and a transfer device for transferring the toner image formed on the surface of the electrophotographic photoreceptor to a recording medium.

* * * * *